US006655664B2

(12) United States Patent
Chuang

(10) Patent No.: US 6,655,664 B2
(45) Date of Patent: Dec. 2, 2003

(54) ADJUSTABLE BUBBLE GENERATOR PRACTICAL FOR USE AS A RELIEF VALVE

(76) Inventor: Shuo Wei Chuang, No. 35, Lane 120, Tien Mu West Rd., Taipei (TW)

( * ) Notice: Subject to any disclaimer, the term of this patent is extended or adjusted under 35 U.S.C. 154(b) by 59 days.

(21) Appl. No.: 10/134,384

(22) Filed: Apr. 30, 2002

(65) Prior Publication Data

US 2003/0201552 A1 Oct. 30, 2003

(51) Int. Cl.[7] ..... B01F 3/04
(52) U.S. Cl. ..... 261/62; 261/71
(58) Field of Search ..... 261/62, 66, 71, 261/81

(56) References Cited

U.S. PATENT DOCUMENTS 355,250 A * 12/1886 Blass ..... 261/62
1,932,764 A * 10/1933 Benjamin et al. ..... 261/50.1
3,778,038 A * 12/1973 Eversole et al. ..... 261/50.1
3,876,398 A * 4/1975 Leisegang ..... 96/261
6,602,916 B2 * 8/2003 Grundmann et al. ..... 516/10

* cited by examiner

*Primary Examiner*—C. Scott Bushey
(74) *Attorney, Agent, or Firm*—Bacon & Thomas, PLLC

(57) ABSTRACT

A bubble generator is constructed to include a cylindrical casing, a tapered tube suspended in a front open side of the casing and adapted for guiding water into the casing, the tapered tube having recessed holes on the inside adapted for causing a negative pressure when water passing through the tapered tube into the inside of the casing toward the water outlet, a rod member axially slidably inserted through a rear closed side of the casing into the inside of the tapered tube, and a stopper fixedly fastened to the rod member and moved with the rod member to adjust the gap between the stopper and the tapered tube.

1 Claim, 3 Drawing Sheets

ADJUSTABLE BUBBLE GENERATOR PRACTICAL FOR USE AS A RELIEF VALVE

BACKGROUND OF THE INVENTION

1. Field of the Invention

The present invention relates to a bubble generator and, more particularly, to an adjustable bubble generator, which functions as a relief valve.

2. Description of the Related Art

During a water treatment procedure, a relief valve is used to control water pressure, causing the pressure of input flow of water to be reduced. A relief valve for this purpose uses a spring plate to control water pressure. However, because the spring plate wears quickly with use, it must be replaced regularly. It is inconvenient and expensive to regularly replace the spring plate. Further, bubble-generating means may be used in a water treatment system to generate bubbles in wastewater for carrying tiny dirt from wastewater to the topside, enabling tiny dirt to be suspended in the topside of water.

SUMMARY OF THE INVENTION

It is one object of the present invention to provide a bubble generator, which functions as a relief valve. It is another object of the present invention to provide a bubble generator, which causes bubbles to be produced in water passing through for carrying dirt from water to the topside. To achieve these and other objects of the present invention, the bubble generator comprises a cylindrical casing, a tapered tube suspended in a front open side of the casing and adapted for guiding water into the casing, the tapered tube having recessed holes on the inside adapted for causing a negative pressure when water passing through the tapered tube into the inside of the casing toward the water outlet, a rod member axially slidably inserted through a rear closed side of the casing into the inside of the tapered tube, and a stopper fixedly fastened to the rod member and moved with the rod member to adjust the gap between the stopper and the tapered tube.

DETAILED DESCRIPTION OF THE PREFERRED EMBODIMENT

Figure 1:
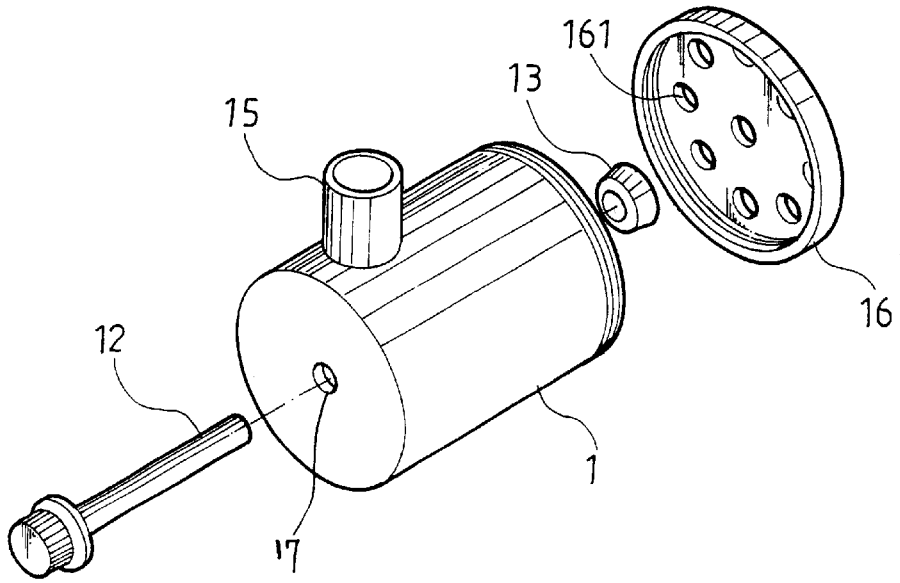
FIG. 1 is an exploded view of a bubble generator according to the present invention.
Figure 2:
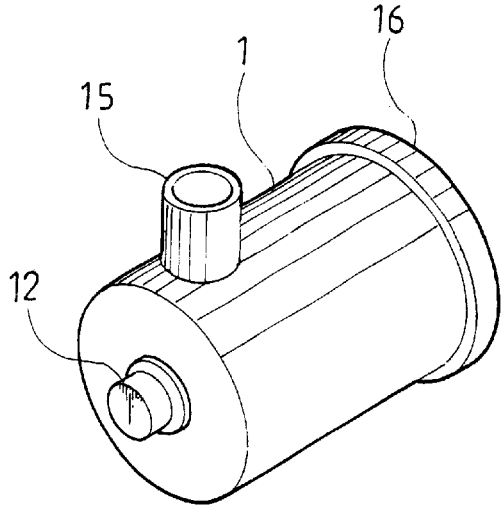
FIG. 2 is an elevational view of the bubble generator according to the present invention.
Figure 3:
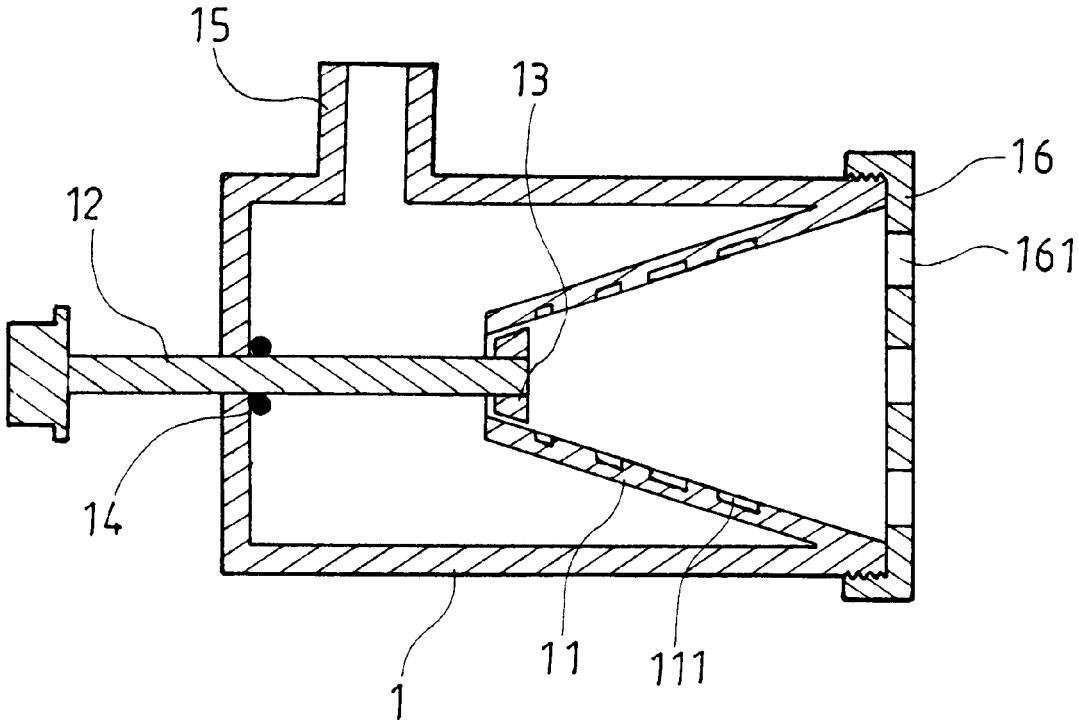
FIG. 3 is a sectional view of the bubble generator according to the present invention.

Referring to FIGS. From 1 through 3, a bubble generator is shown comprising a cylindrical casing 1, the cylindrical casing 1 having an outlet 15 perpendicularly protruded from the periphery, a tapered tube 11 inwardly extended from the periphery of one side, namely, the front open side of the cylindrical casing 1 and suspended inside the cylindrical casing 1, the tapered tube 11 having a plurality of recessed holes 111 of different sizes respectively disposed in the inside wall, a rod member 12 inserted through the center hole 17 of the other side, namely, the rear closed side of the cylindrical casing 1 into the inside of the tapered tube 11, a stopper 13 fixedly fastened to one end of the rod member 12 and moved with the rod member 12 in the tapered tube 11 to close/open the passage through the tapered tube 11, and a gasket ring 14 fixedly mounted inside the casing 11 around the rod member 12 to seal the center hole 17. Further, a cap 16 is covered on the front open side of the cylindrical casing 1, having a plurality of through holes 161 adapted for guiding water in streams into the inside of the tapered tube 11.

Figure 4:
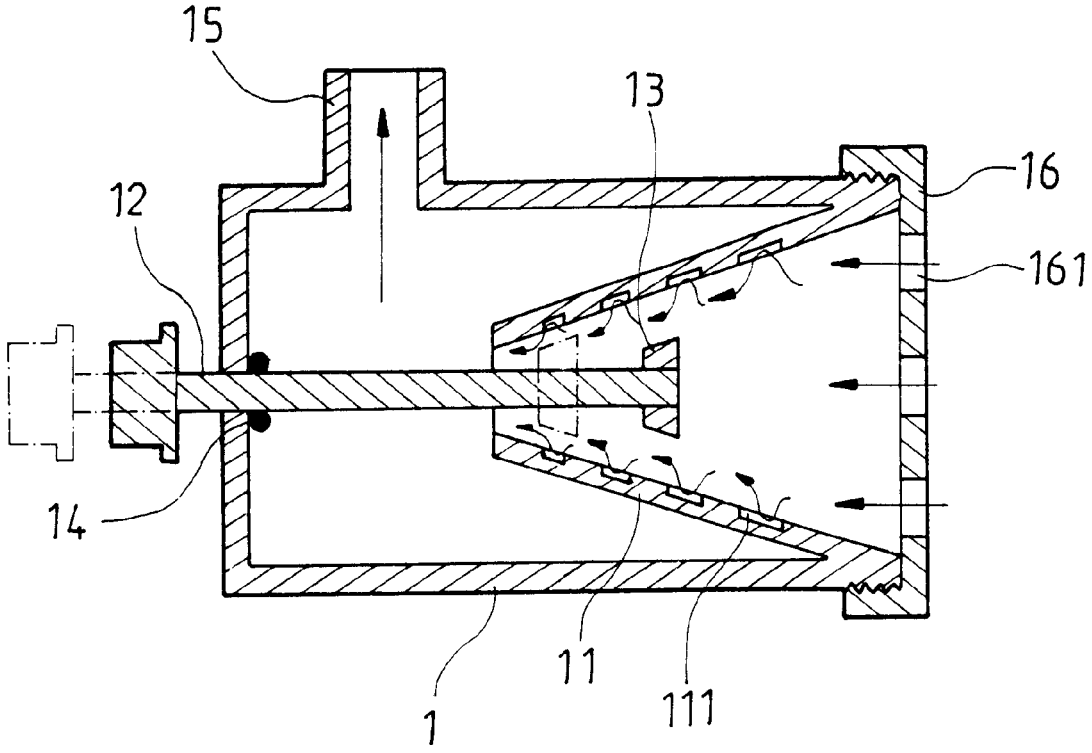
FIG. 4 is a schematic drawing showing the operation of the bubble generator according to the present invention.

Referring to FIG. 4, when in use, water flows through the through holes 161 of the cap 16, and then passes through the gap between the stopper 13 and the inside wall of the tapered tube 11 to the inside of the cylindrical casing 1, and then passes from the inside space of the cylindrical casing 1 to the outside through the outlet 15. When water passed through the tapered tube 11 to the inside of the cylindrical casing 1, water pressure is relatively reduced. When flowing over the recessed holes 111 of the tapered tube 11, a negative pressure is produced in water, water is agitated violently, and at the same time bubbles are produced in water. Bubbles in the continuous flow of water are effective to carry dirt upwards to the water level.

Referring to FIG. 4 again, the user can move the rod member 12 axially relative to the tapered tube 11 to adjust the gap between the stopper 13 and the inside wall of the tapered tube 11, so as to further adjust water pressure.

A prototype of bubble generator has been constructed with the features of the annexed drawings of FIGS. 1~4. The bubble generator functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bubble generator comprising:

a cylindrical casing, said cylindrical casing having a front open side, a rear closed side, a center hole through the center of said rear closed side, and a water outlet perpendicularly protruded from the periphery thereof and adapted for guiding out water from said front open side;

a tapered tube inwardly extended from the periphery of the front open side of said cylindrical casing and suspended inside said cylindrical casing, said tapered tube having a plurality of recessed holes of different sizes respectively disposed in an inside wall thereof and an inner diameter gradually reducing from the front open side of said cylindrical casing toward the closed rear side of said cylindrical casing;

a rod member axially slidably inserted through the center hole of the rear closed side of said cylindrical casing into the inside of said tapered tube; and a stopper fixedly fastened to one end of said rod member and suspended inside said tapered tube and moved with said rod member relative to said tapered tube to adjust the gap between said stopper and said tapered tube.

* * * * *